US005387841A

United States Patent [19]

Lewis

[11] Patent Number: 5,387,841

[45] Date of Patent: Feb. 7, 1995

[54] MAGNETRON HAVING AN ANODE WITH COOLING CHANNELS

[75] Inventor: Peter F. Lewis, Chelmsford, United Kingdom

[73] Assignee: EEV Limited, Essex, United Kingdom

[21] Appl. No.: 935,108

[22] Filed: Aug. 27, 1992

[30] Foreign Application Priority Data

Aug. 30, 1991 [GB] United Kingdom ..... 9118651
Nov. 11, 1991 [GB] United Kingdom ..... 9123906

[51] Int. Cl.[6] ..... H01J 25/50

[52] U.S. Cl. ..... 315/39.75; 313/24; 313/35

[58] Field of Search ..... 315/39.51, 39.75; 313/22, 24, 35

[56] References Cited

U.S. PATENT DOCUMENTS

| | | | |
|---|---|---|---|
| 2,612,623 | 9/1952 | Spencer | 315/39.51 X |
| 3,096,462 | 2/1963 | Feinstein | 315/39.75 X |
| 4,256,990 | 3/1981 | Busacca et al. | 315/39.51 X |
| 4,274,032 | 6/1981 | Dodonov et al. | 313/39 X |

FOREIGN PATENT DOCUMENTS

| | | | |
|---|---|---|---|
| 3297034 | 12/1991 | Japan | 315/39.51 |
| 570679 | 7/1945 | United Kingdom . | |
| 675175 | 7/1952 | United Kingdom . | |
| 675176 | 7/1952 | United Kingdom . | |
| 710552 | 6/1954 | United Kingdom . | |
| 800588 | 8/1958 | United Kingdom . | |
| 942685 | 11/1963 | United Kingdom . | |
| 1194249 | 6/1970 | United Kingdom . | |
| 1492505 | 11/1977 | United Kingdom . | |
| 2056163 | 3/1981 | United Kingdom . | |
| 906294 | 11/1991 | U.S.S.R. | 315/39.75 |

*Primary Examiner*—Benny T. Lee
*Attorney, Agent, or Firm*—Spencer, Frank & Schneider

[57] ABSTRACT

A magnetron comprises a cathode and an anode, the anode comprising a substantially cylindrical anode block having a plurality of internal resonant cavities. A pair of enclosed channels extend about the block, a coolant inlet being present in one of the channels and a coolant outlet being present in the other of the channels, the channels being connected to each other along their length by one or more connecting passageways dimensioned relative to the channels to provide a restriction so as the enhance coolant flow velocity, in use, through the connecting passageway.

16 Claims, 2 Drawing Sheets

MAGNETRON HAVING AN ANODE WITH COOLING CHANNELS

BACKGROUND OF THE INVENTION

The invention relates to a magnetron, and in particular to a magnetron of relatively high power for which there is a requirement for efficient cooling. It is known to provide fins by which the magnetron can be cooled by a flow of air, but a need exists for an efficient cooling arrangement which is reliable and easy to provide.

SUMMARY OF THE INVENTION

The invention provides a magnetron comprising a cathode and an anode, the anode comprising a substantially cylindrical anode block having a plurality of internal resonant cavities, a pair of enclosed channels extending about the block, a coolant inlet being present in one of the channels and a coolant outlet being present in the other, the channels being connected to each other along their length by at least one connecting passageway dimensioned relative to the channels to provide a restriction to enhance coolant flow velocity, in use, through the passageway.

Each of the channels can be provided on the anode block by a straight forward turning operation at the same time as the anode block is made. The connecting passageway provides a restriction which, because of the locally enhanced velocity of the coolant, ensures that heat may be efficiently removed in the region of the passageway, and uniformly from the anode block.

In a preferred embodiment, a sleeve surrounds the anode block to enclose the channels, the anode block including an outwardly extending wall which separates the channels from one another and which, together with the sleeve, defines a connecting passageway.

It is also preferred that the channels and the separating wall are integrally formed with the outer most surface of the anode block. Each channel preferably surrounds an end region of the set of resonant cavities of the anode, and the connecting passageway is located mid-way between the end regions. The dimensions of the connecting passageway are preferably selected so that turbulent flow can be induced in use, within the coolant passing therethrough. In this way heat can be efficiently removed at a greater rate where the requirement for cooling is greatest.

Although the connecting passageway may comprise an annulus defined between a wall separating the channels and a sleeve enclosing the anode block, in an alternative construction a plurality of longitudinally extensive connecting passageways are circumferentially spaced about the anode block. Such longitudinally extensive connecting passageways may be provided by means of a plurality of longitudinally extending circumferentially spaced ribs present on the top of the separating wall, and which serve both to space the wall from the sleeve, and to subdivide the annular passageway into a plurality of relatively smaller passageways.

BRIEF DESCRIPTION OF THE DRAWINGS

In order that the invention may be well understood, an embodiment thereof will now be described by way of example with reference to the accompanying drawings, in which.

DETAILED DESCRIPTION OF THE PREFERRED EMBODIMENT

Figure 2:
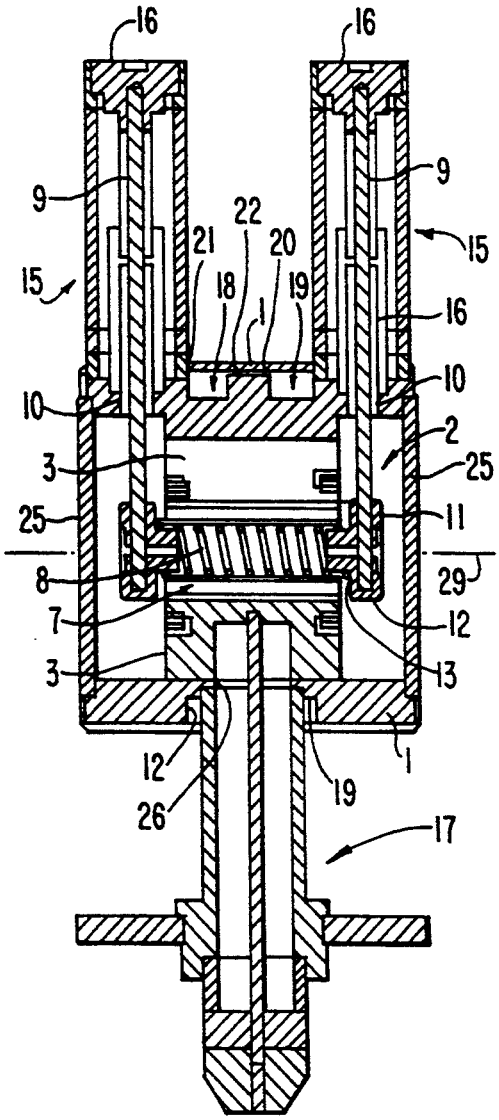
FIG. 2 is a sectional view along line 2—2 of FIG. 1.
Figure 1:
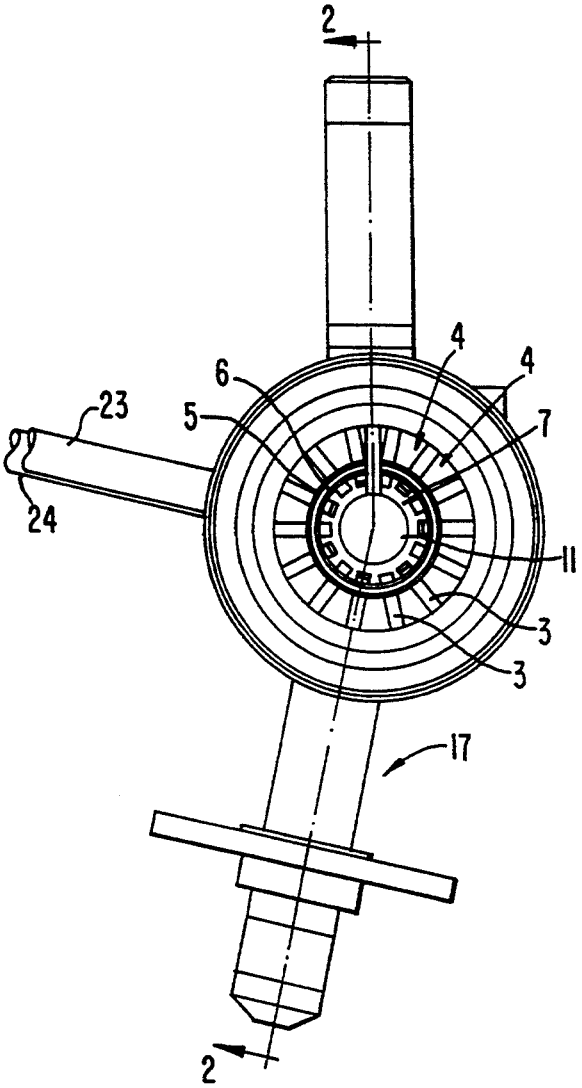
FIG. 1 is a side view of a magnetron with the end caps removed to reveal the interior.

As shown in the drawings, a vacuum envelope for a magnetron comprises a generally cylindrical anode block 1 which includes an open ended cavity 2. Circumferentially spaced anode vanes 3 extend inwardly from the anode block 1 to define a plurality of circumferentially spaced resonant cavities 4 as best seen in FIG. 1. Alternate vanes 3 are strapped together in known fashion by means of one of two rings 5, 6. The vanes 3 stop short of the major axis 29 of the cylindrical anode block to define a cylindrical space 7 within which a thoriated tungsten coil cathode 8 is located. Referring to FIG. 2, the coil 8 is supported at each end within the cylindrical space 7 by means of an elongate conducting pin 9 which extends radially out through a hole 10 in the anode block 1. The pins 9 are arranged both to support the coil 8 in spaced relation from the anode and to supply electrical current to and from the coil 8. Each pin 9 extends into a hole within the rim 11 of a top-hat shaped end cap 12. Each end cap 12 includes a spigot portion 13 which extends into and is brazed within the adjacent open end of the coil 8.

A choke arrangement 15 surrounds the portion of the pin 9 extending outwardly of the anode block 1 to shield the pin against the emission of electromagnetic radiation. A terminal 16 is attached to the free end of each pin 9 for supplying electrical current to and from the cathode coil 8.

A pair of ring shaped channels 18, 19 surround the central region of the anode block 1 within which the anode vanes 3 are located. The channels 18, 19 are separated along their length from one another by means of an annular ring shaped wall 20 extending outwardly of the anode block. The channels 18, 19 and wall 20 are arranged co-axially with the major axis of the anode block 1. A cylindrical sleeve 21 surrounds the anode block 1 and includes appropriate holes to receive the two choke arrangements 15 and an output probe 17, discussed later on. The wall 20 stops short of the sleeve 21 to define an annular passageway 22 connecting the channels together along their length. The channels 19 each surround a region of the anode block adjacent the ends of the anode vanes, with the wall 20 being located about a region intermediate the ends of the vanes 3.

An inlet and an outlet pipe 23, 24 (see FIG. 1) extend into a respective one of the channels 18, 19 for supplying a liquid coolant, e.g., water, which flows round one of the channels 18. From there, the layer of coolant adjacent the passageway 22 will pass through the passageway before passing into the second channel and out of the outlet 24, the flow being generally helical in direction. The output probe assembly 17, (see FIG. 1) for emitting the produced energy, extends out through a complementary hole 26 in the anode block which passes through the wall 20 and into portions of the channel, as is shown in FIG. 2. The probe 17 is sealed within the hole 26 so that coolant cannot flow from channel to channel around the probe. A pair of anode end plates 25 seal off each end of the cavity 2.

The cross-sectional area of the connecting passageway 22 in the direction of fluid flow, i.e., parallel to the major axis 29 of the cylindrical anode block, is much reduced compared to the cross-sectional area of each of the channels 18, 19. In this way the connecting passageway provides a restriction within which the fluid flow velocity can be increased, depending on the coolant flow rate, to such an extent that the fluid flow within that region is turbulent, i.e., the Reynolds number is greater than about 2,000. In this way the cooling effect is enhanced in the central region of the anode block adjacent to the wall 20, where the requirement for cooling is greatest. Furthermore the construction of two parallel channels 18, 19 is relatively easy to provide with a turning operation using a lathe or milling machine at the same time the anode block is made.

In an example, channels about 6 mm wide and about 4 mm high were separated by a wall 4 mm wide having a connecting passageway of height 0.75 mm. With a flow rate of water of about 10 liters per minute, it was found that the magnetron was well cooled.

Figure 3:
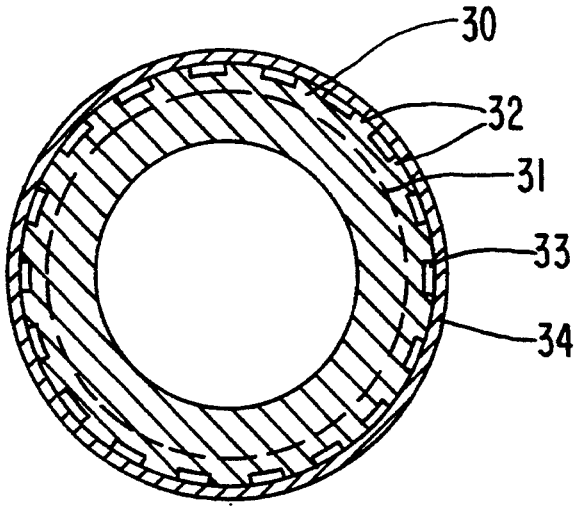
FIG. 3 is a cross-section view through an alternative embodiment in which the internal and other features have been omitted for clarity.

The invention is not limited to the embodiment shown in FIGS. 1 and 2. For example, as shown in FIG. 3, a wall 30 separating a pair of channels 31 (shown in dotted outline) includes a plurality of circumferentially spaced longitudinally extending ribs 32 which, in effect, subdivides the annular passageway of the FIGS. 1 and 2 embodiment into a plurality of smaller passageways 33 and serve to space the wall from an enclosing sleeve 34. In other alternative arrangements, the sleeve may include an inwardly extensive partition which divides a relatively large recess into the two channels. More than two channels may be present. The channels need not be ring shaped, as shown, but could be, e.g., generally wavy or sinusoidal, when viewed from the side.

I claim:

1. A magnetron comprising an anode, the anode comprising:

a substantially cylindrical anode block having a major axis, a plurality of resonant cavities and a cathode spaced from and surrounded by the anode block, a pair of ring shaped channels together with a ring shaped separating wall integral with and arranged in side-by-side relation coaxially with the major axis of the anode block, a sleeve surrounding the anode block to enclose the channels and which, together with the separating wall, provides at least one connecting passageway which connects the channels, a coolant inlet pipe passing through the sleeve and into one of the channels, and a coolant outlet pipe passing through the sleeve into the other of the channels, the connecting passageway providing a restriction to enhance, in use, a velocity of coolant flowing between the inlet and outlet pipes through the connecting passageway.

2. A magnetron, according to claim 1, in which the channels are each of a rectangular cross-section.

3. A magnetron according to claim 1, in which the connecting passageway is of annular shape.

4. A magnetron, according to claim 1, wherein the at least one connecting passageway further comprises a plurality of passageways extending parallel to the major axis of the anode block.

5. A magnetron according to claim 4, in which dimensions of each connecting passageway are such that turbulent flow can be induced, in use, within the coolant passing therethrough.

6. A magnetron according to claim 4 further comprising a plurality of spaced apart ribs upon the separating wall and extending parallel to the major axis of the anode block, at least one connecting passageway being provided by the spaces between adjacent ribs.

7. A magnetron, according to claim 1, in which each channel surrounds a respective end region of the resonant cavities of the anode block, and the connecting passageway is located midway between the end regions.

8. A magnetron, according to claim 1, in which dimensions of the connecting passageway are such that turbulent flow can be induced, in use, within the coolant passing therethrough.

9. A magnetron comprising:

a substantially cylindrically shaped anode block having an inner surface, an outer surface and a major axis, the anode block including a plurality of anode vanes extending from the inner surface towards the major axis thereby defining a plurality of resonant cavities, a respective resonant cavity being disposed between adjacent anode vanes;

a cathode spaced from and surrounded by the anode block along the major axis and spaced from the plurality of anode vanes;

the outer surface of the anode block including at least a first annular channel and a second annular channel arranged coaxially with the major axis and in a region of the anode block intermediate the anode vanes, the at least first and second annular channels being separated by a wall having at least one passageway coupling the annular channels together;

a sleeve surrounding the anode block and enclosing the annular channels;

a coolant inlet pipe coupled to the first annular channel through the sleeve for supplying coolant to the first annular channel; and a coolant outlet pipe coupled to the second annular channel through the sleeve for removing coolant from the second annular channel;

the at least one passageway having a cross sectional area which is reduced from a cross sectional area associated with each of the annular channels.

10. A magnetron according to claim 9, wherein dimensions of the at least one passageway induces turbulent coolant flow within the coolant passing through the passageway.

11. A magnetron according to claim 9, wherein the annular channels each have a rectangular cross sectional area.

12. A magnetron according to claim 9, wherein the at least one connecting passageway further comprises a plurality of passageways extending parallel to the major axis between the annular channels.

13. A magnetron according to claim 12, further comprising a plurality of spaced apart ribs formed on the wall between the annular channels and extending parallel to the major axis, the plurality of passageways being formed by spaces between adjacent ribs.

14. A magnetron according to claim 12, wherein dimensions of each passageway induces turbulent flow within coolant passing through each respective passageway.

15. A magnetron according to claim 9, wherein the at least one passageway has an annular cross sectional area.

16. A magnetron according to claim 9, wherein each annular channel surrounds a respective end region of the resonant cavities, and the at least one passageway is located midway between the end regions.

* * * * *